US009201395B2

(12) United States Patent
Uchida et al.

(10) Patent No.: US 9,201,395 B2
(45) Date of Patent: Dec. 1, 2015

(54) IMAGE FORMING APPARATUS WITH INTERMEDIATE TRANSFER BELT COOLING CHAMBER

(71) Applicant: KYOCERA Document Solutions Inc., Osaka (JP)

(72) Inventors: Kosuke Uchida, Osaka (JP); Kazuya Yamashita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/444,085

(22) Filed: Jul. 28, 2014

(65) Prior Publication Data

US 2015/0037061 A1 Feb. 5, 2015

(30) Foreign Application Priority Data

Jul. 30, 2013 (JP) ..... 2013-158099

(51) Int. Cl.
*G03G 21/20* (2006.01)
*G03G 15/16* (2006.01)

(52) U.S. Cl.
CPC ..... *G03G 21/206* (2013.01); *G03G 15/161* (2013.01); *G03G 2221/1645* (2013.01)

(58) Field of Classification Search
CPC ..... G03G 2221/1645; G03G 21/206
See application file for complete search history.

(56) References Cited

U.S. PATENT DOCUMENTS

| | | | | |
|---|---|---|---|---|
| 6,603,938 | B2 * | 8/2003 | Tsubakimoto | 399/92 |
| 7,747,186 | B2 * | 6/2010 | Miyamoto et al. | 399/92 |
| 2003/0165345 | A1 * | 9/2003 | Chikano | 399/92 |
| 2007/0212104 | A1 | 9/2007 | Miyamoto et al. | |

FOREIGN PATENT DOCUMENTS

| | | | |
|---|---|---|---|
| JP | 10340037 | A * | 12/1998 |
| JP | 11038808 | A * | 2/1999 |
| JP | 2004288676 | A * | 10/2004 |
| JP | 2007-240703 | A | 9/2007 |

* cited by examiner

*Primary Examiner* — Clayton E LaBalle
*Assistant Examiner* — Leon W Rhodes, Jr.
(74) *Attorney, Agent, or Firm* — Studebaker & Brackett PC

(57) ABSTRACT

An image forming apparatus includes an intermediate transfer belt, a cooling chamber to cool the intermediate transfer belt, a fixing section, a cooling fan, and a frame. The cooling chamber is defined immediately above the intermediate transfer belt. The fixing section is arranged on one side of the cooling chamber and configured to fix to a sheet the toner image transferred to the sheet by heating the toner image. The cooling fan is arranged on the other side of the cooling chamber and configured to introduce external air to the cooling chamber. The frame has an exhaust port for releasing air in the cooling chamber and is arranged on the other side of the cooling chamber.

6 Claims, 5 Drawing Sheets

IMAGE FORMING APPARATUS WITH INTERMEDIATE TRANSFER BELT COOLING CHAMBER

INCORPORATION BY REFERENCE

The present application claims priority under 35 U.S.C. §119 to Japanese Patent Application No. 2013-158099, filed Jul. 30, 2013. The contents of this application are incorporated herein by reference in their entirety.

BACKGROUND

The present disclosure relates to image forming apparatuses including an intermediate transfer belt.

Recently, image forming apparatuses such as full-color printers, full-color copiers, etc. of so-called tandem type have become general. A tandem type image forming apparatus includes photosensitive drums corresponding to four colors of cyan, magenta, yellow, and black. The tandem type image forming apparatus can form color images at an increased speed.

The tandem type image forming apparatus includes an intermediate transfer belt wound to a plurality of rollers. Toner images formed on the respective photosensitive drums are transferred to the intermediate transfer belt.

Each photosensitive drum is heated by voltage application by a charger, laser irradiation by an optical scanning device, and the like. The intermediate transfer belt is in contact with the photosensitive drums to be heated by the heat of the photosensitive drums. In addition, the intermediate transfer belt may be heated by radiation heat from a fixing section.

When the intermediate transfer belt is heated, toner transferred to the intermediate transfer belt may be melted and adheres to the intermediate transfer belt. Further, the heated intermediate transfer belt can draw less heat from the photosensitive drums, thereby making it difficult for the intermediate transfer belt to cool the photosensitive drum.

In view of the above drawbacks, an image forming apparatus is proposed that includes a cooling mechanism to cool the intermediate transfer belt. The cooling mechanism includes a first cooling fan, a second cooling fan, and an exhaust fan. The first cooling fan takes in the external air into the interior of the main body of the image forming apparatus. The second cooling fan sends the external air taken in into the interior of the main body by the first cooling fan toward the upper surface of the intermediate transfer belt. The exhaust fan discharges the air used for cooling to the exterior of the main body.

The first and second cooling fans are arranged on one side of the intermediate transfer belt. The fixing section is arranged on the other side of the intermediate transfer belt. The exhaust fan is arranged beside the fixing section.

The cooling mechanism further includes a duct member arranged in the vicinity of the fixing section. An air flow supplied from the second cooling fan is introduced to the duct member to form an air curtain. Thus, the intermediate transfer belt can be prevented from being heated by the fixing section.

SUMMARY

An image forming apparatus according to the present disclosure includes a plurality of photosensitive drums, an intermediate transfer belt, and a transfer section. The intermediate transfer belt is wound to a plurality of rollers. The intermediate transfer belt is configured to be in contact with outer peripheral surfaces of the photosensitive drums such that toner images are transferred to the intermediate transfer belt from the outer peripheral surfaces of the photosensitive drums. The transfer section is configured to transfer a toner image from the intermediate transfer belt to a sheet. The image forming apparatus according to the present disclosure further includes a cooling chamber to cool the intermediate transfer belt, a fixing section, a cooling fan, and a frame. The cooling chamber is defined immediately above the intermediate transfer belt. The fixing section is arranged on one side of the cooling chamber. The fixing section is configured to fix to a sheet the toner image that the transfer section transfers to the sheet by heating the toner image. The cooling fan is arranged on the other side of the cooling chamber. The cooling fan introduces external air to the cooling chamber. The frame has an exhaust port for releasing air in the cooling chamber. The frame is arranged on the other side of the cooling chamber.

DETAILED DESCRIPTION

Embodiments of the present disclosure will be described in detail below with reference to the accompanying drawings. It is noted that the present disclosure should not be limited to the following embodiments.

Figure 1:
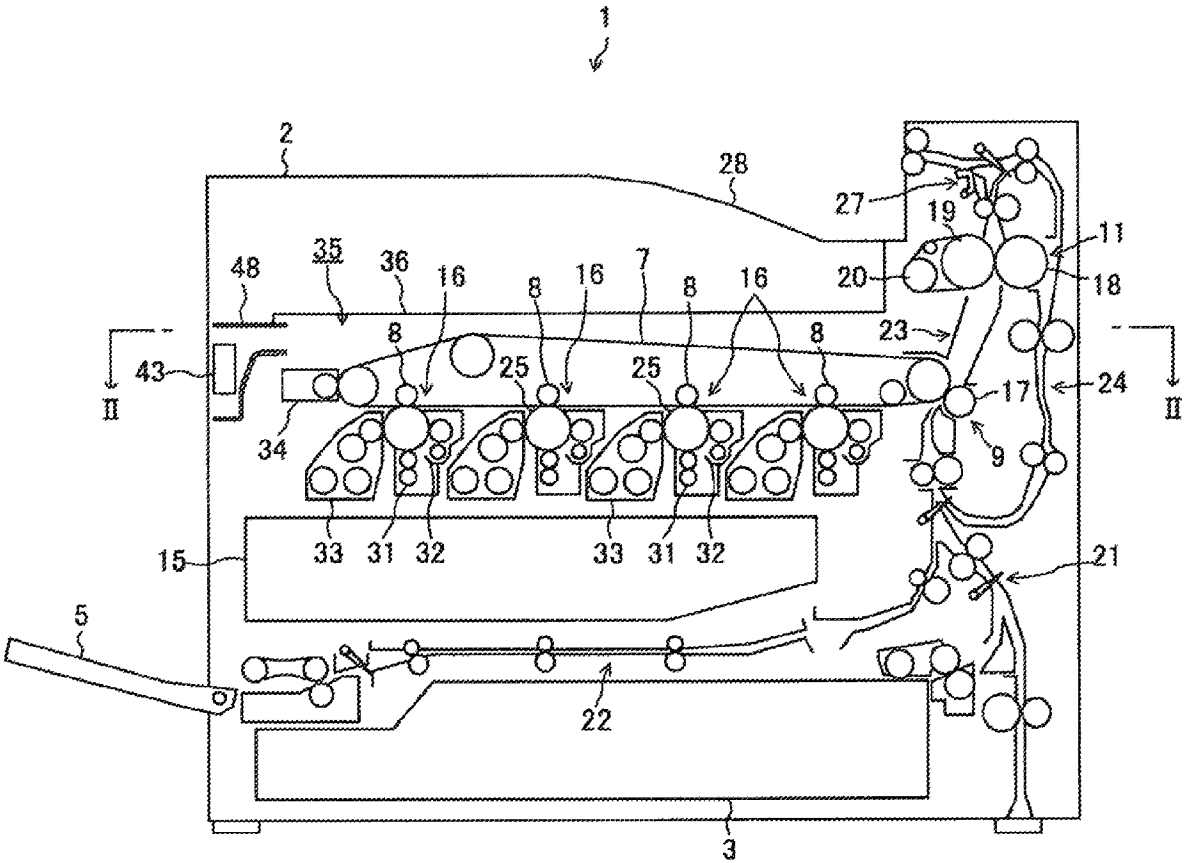
FIG. 1 is a cross sectional view schematically showing a configuration of an image forming apparatus according to one embodiment.

FIG. 1 is a cross sectional view schematically showing a configuration of an image forming apparatus 1. The image forming apparatus 1 is a color printer of tandem type. The image forming apparatus 1 includes, as shown in FIG. 1, an intermediate transfer belt 7, a plurality of primary transfer sections 8, a secondary transfer section 9, a fixing section 11, an optical scanning device 15, and a plurality of image forming sections 16.

A sheet feed cassette 3 is arranged in the lower part of a main body 2 of the image forming apparatus 1. The sheet feed cassette 3 accommodates in its interior sheets of paper or the like (not shown) before subjected to printing. The sheet feed cassette 3 accommodates a plurality of sheets in a state in which the sheets are loaded in the sheet feed cassette 3. A sheet sent out from the sheet feed cassette 3 is received by a first sheet conveyance section 21. The first sheet conveyance section 21 is arranged on one side of the sheet feed cassette 3. The first sheet conveyance section 21 receives the sheet sent out from the sheet feed cassette 3 and conveys it to the secondary transfer section 9 arranged thereabove.

A manual sheet feed section 5 is provided on the opposite side of the sheet feed cassette 3 to the first sheet conveyance section 21. The manual sheet feed section 5 is externally mounted on the main body 2 such that its part is inserted in the main body 2. A sheet of paper or the like sent out from the manual sheet feed section 5 is received by a second sheet conveyance section 22. The second sheet conveyance section 22 is arranged between the manual sheet feed section 5 and the first sheet conveyance section 21. The second sheet conveyance section 22 receives a sheet of paper or the like sent out from the manual sheet feed section 5 and conveys it to the first sheet conveyance section 21.

The optical scanning device 15 is arranged above the second sheet conveyance section 22. The optical scanning device 15 irradiates each image forming section 16 with laser light based on image data that the image forming apparatus 1 receives. Above the optical scanning device 15, for example, four image forming sections 16 are arranged. The image forming apparatus 1 in the present embodiment includes four image forming sections 16. The intermediate transfer belt 7, which is endless, is provided above the image forming sections 16. The intermediate transfer belt 7 is wound to a plurality of rollers. Driving at least one of the rollers by a driving device (not shown) causes rotation of the intermediate transfer belt 7.

Each of the four image forming sections 16 includes a photosensitive drum 25 serving as an image bearing member. The intermediate transfer belt 7 is in contact with the outer peripheral surfaces of the photosensitive drums 25 such that toner images are transferred to the intermediate transfer belt 7 from the outer peripheral surfaces of the photosensitive drums 25.

The four image forming sections 16 are arranged in a row along the intermediate transfer belt 7, as shown in FIG. 1. The four image forming sections 16 form respective toner images of yellow, magenta, cyan, or black colors. Each of the image forming sections 16 includes, in addition to the photosensitive drum 25, a charger 31, a development section 33, and a cleaning section 32 around the corresponding photosensitive drum 25.

The charger 31 charges the corresponding photosensitive drum 25. The laser light is irradiated to the charged photosensitive drums 25 from the optical scanning device 15. Thus, electrostatic latent images are formed on the photosensitive drums 25. The development section 33 develops the electrostatic latent image formed on the corresponding photosensitive drum 25. Thus, toner images are formed on the outer peripheral surfaces of the photosensitive drums 25.

The primary transfer sections 8 are arranged above the image forming sections 16. The image forming apparatus 1 in the present embodiment includes four primary transfer 8. Each primary transfer section 8 includes a transfer roller. The transfer roller primarily transfers a toner image formed on the outer peripheral surface of the corresponding photosensitive drum 25 to the surface of the intermediate transfer belt 7.

When the intermediate transfer belt 7 is rotated, the toner images on the photosensitive drums 25 are transferred to the intermediate transfer belt 7 with predetermined timing, resulting in formation of a color toner image on the surface of the intermediate transfer belt 7. The color toner image is formed by superposing toner images in four colors of yellow, magenta, cyan, and black. After transfer of the toner images to the intermediate transfer belt 7, the cleaning section 32 cleans the outer peripheral surface of the corresponding photosensitive drum 25.

The secondary transfer section 9 includes a transfer roller 17 arranged on one side of the intermediate transfer belt 7, as shown in FIG. 1. The secondary transfer section 9 applies a transfer bias voltage having a reverse polarity to that of the toner to the sheet sent from the first sheet conveyance section 21, thereby transferring a color toner image from the intermediate transfer belt 7 to the sheet.

The image forming apparatus 1 includes a belt cleaning section 34 arranged on the opposite side of the intermediate transfer belt 7 to the secondary transfer section 9. The belt cleaning section 34 cleans the surface of the intermediate transfer belt 7 after transfer of a color toner image to a sheet.

The fixing section 11 is arranged above the secondary transfer section 9. A sheet to which a color toner image is secondary transferred is conveyed to the fixing section 11 through a third sheet conveyance section 23. The third sheet conveyance section 23 is arranged between the secondary transfer section 9 and the fixing section 11. The fixing section 11 includes a pressure roller 18, a fixing roller 19, and a heating roller 20. The fixing section 11 fixes the color toner image to the sheet conveyed through the third sheet conveyance section 23 by applying heat and pressure to the sheet.

In simplex printing, a sheet ejected from the fixing section 11 is ejected from a branch section 27 to a sheet ejecting section 28. The branch section 27 is provided above the fixing section 11. The sheet ejecting section 28 is formed on top of the image forming apparatus 1. In duplex printing, the sheet is conveyed again to the secondary transfer section 9 through a fourth sheet conveyance section 24 from the branch section 27.

Figure 2:
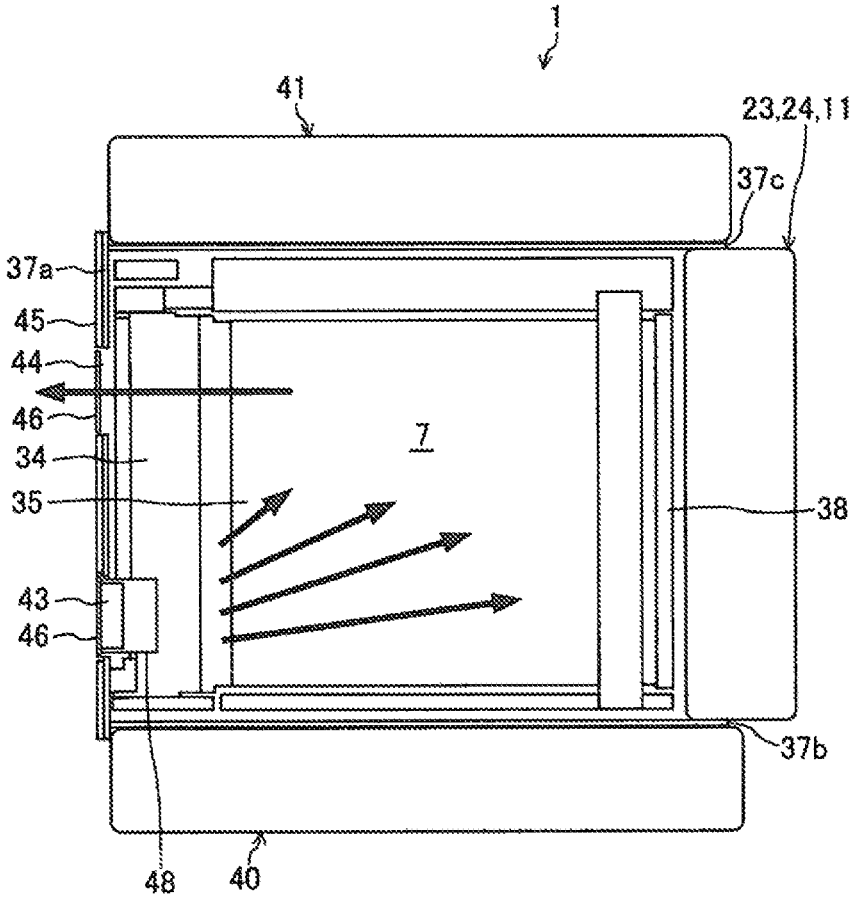
FIG. 2 is a diagram schematically showing a section taken along the line II-II in FIG. 1.
Figure 3:
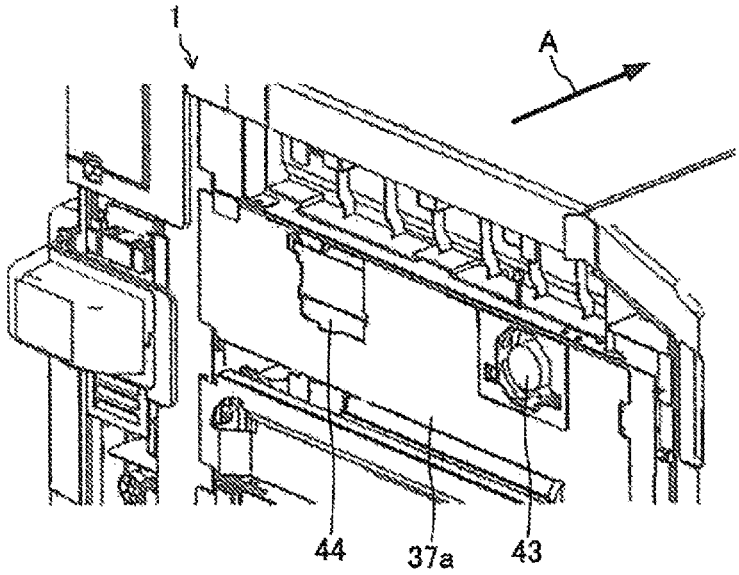
FIG. 3 is a perspective view showing a main body frame according to the embodiment.
Figure 4:
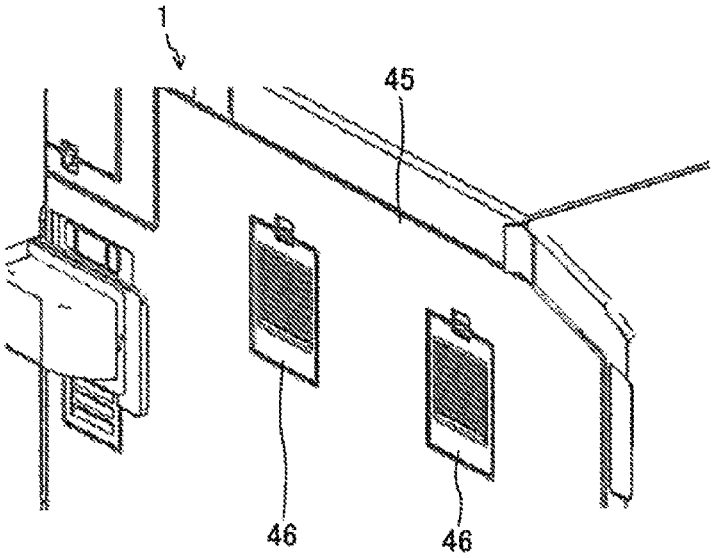
FIG. 4 is a perspective view showing a side cover according to the embodiment.

FIG. 2 is a diagram schematically showing a section taken along the line II-II in FIG. 1. FIG. 3 shows a main body frame 37*a*. FIG. 4 shows a side cover 45 that covers the main body frame 37*a*.

As shown in FIGS. 1 and 2, the image forming apparatus 1 includes a cooling chamber 35 to cool the intermediate transfer belt 7. The cooling chamber 35 is defined immediately above the intermediate transfer belt 7. Specifically, the bottom of the cooling chamber 35 is defined by the intermediate transfer belt 7. The top thereof is defined by a partition plate 36. Main body frames 37*a*, 37*b*, 37*c* of the image forming apparatus 1 and a blocking section 38 define the surround of the cooling chamber 35.

More specifically, the third sheet conveyance section 23, the fourth sheet conveyance section 24, and the fixing section 11 (hereinafter collectively referred to as the fixing section 11 and the like) are arranged on one side of the cooling chamber 35 that is the right side of the cooling chamber 35 in FIG. 2. The blocking section 38 is arranged between the cooling chamber 35 and the fixing section 11 and the like. The blocking section 38 blocks an air flow from the cooling chamber 35.

By contrast, the main body frame 37*a* is arranged on the other side of the cooling chamber that is the left side of the cooling chamber 35 in FIG. 2. The other side of the cooling chamber 35 is opposite side to the fixing section 11 and the like. The main body frame 37*a* is covered with the side cover 45, as shown in FIG. 4.

Further, an inner unit 40 is provided on one side of the cooling chamber 35 that is the lower side thereof in FIG. 2. The inner unit 40 includes a toner supply path (not shown) for toner supply to the development section 33, and the like. The main body frame 37*b* is arranged between the cooling chamber 35 and the inner unit 40. By contrast, a drive unit 41 is provided together with a circuit substrate (not shown) and the like on another side of the cooling chamber 35 that is the upper side thereof in FIG. 2. The drive unit 41 drives various rollers and the like. The main body frame 37*c* is arranged between the cooling chamber 35 and the drive unit 41.

Still further, as shown in FIGS. 2 and 3, a cooling fan 43 and an exhaust port 44 are provided on the opposite side of the cooling chamber 35 to the fixing section 11 and the like. The cooling fan 43 is mounted on the main body frame 37*a*. The exhaust port 44 is formed in the main body frame 37*a*. The cooling fan 43 cools the intermediate transfer belt 7 by introducing the external air to the cooling chamber 35. The exhaust port 44 is formed to release air in the cooling chamber 35.

The cooling fan 43 is constituted by an axial fan that rotates counterclockwise when viewing the cooling chamber 35 in an external air introducing direction A shown in FIG. 3. Herein, the external air introducing direction A is an axial flow direction of the axial fan, that is, the cooling fan 43. In other words, the external air introducing direction A is a direction in which the axial fan (the cooling fan 43) introduces the external air to the cooling chamber 35. When viewing the cooling chamber 35 in the external air introducing direction A, the cooling fan 43 is arranged in the right part of the cooling chamber 35, while the exhaust port 44 is formed in the left part thereof.

The exhaust port 44 is formed through the main body frame 37*a*. The cooling fan 43 is fitted to an opening formed through the main body frame 37*a*. The exhaust port 44 and the cooling fan 43 are covered with respective covering members 46 in each of which a plurality of slits are formed, as shown in FIG. 4. Each covering member 46 is mounted on the side cover 45.

Figure 5:
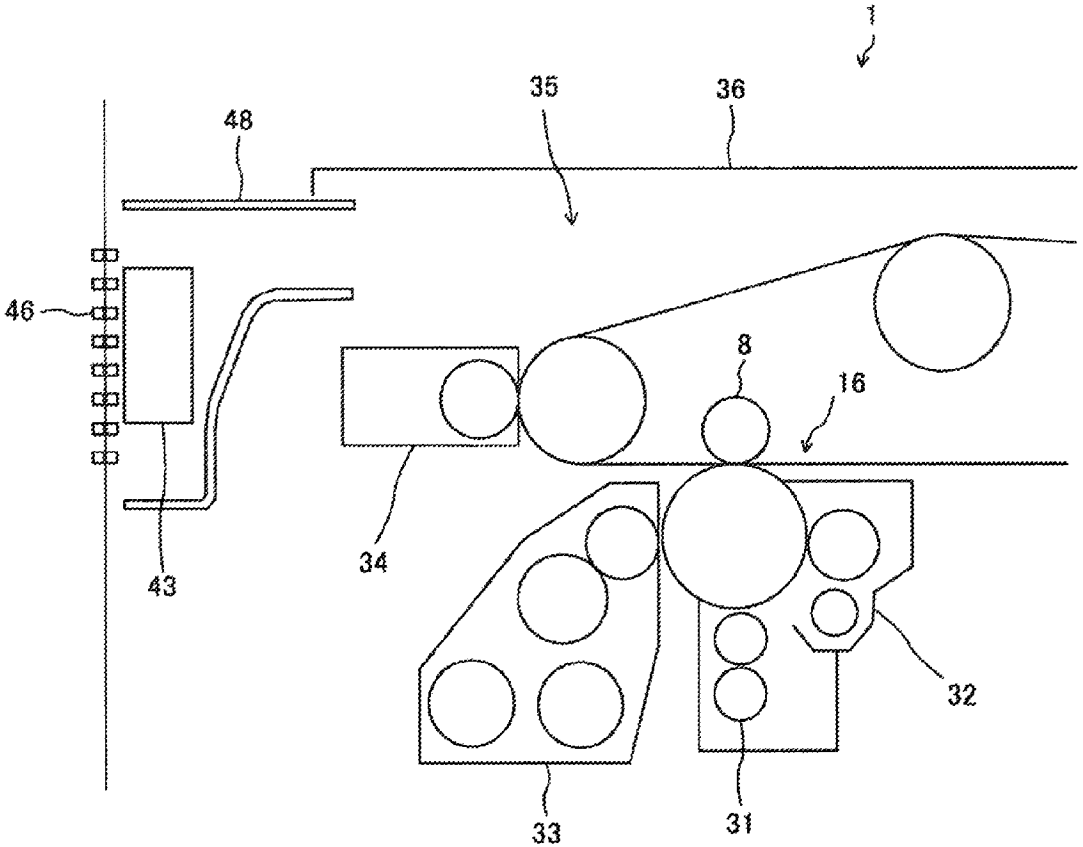
FIG. 5 is a cross sectional view in an enlarged scale schematically showing a configuration of a cooling fan and its vicinity according to the embodiment.

FIG. 5 shows the cooling fan 43 and its vicinity in the image forming apparatus 1 in an enlarged scale. As shown in FIG. 5, the image forming apparatus 1 includes a duct 48 arranged beside the intermediate transfer belt 7. The duct 48 guides the external air blown from the cooling fan 43 to the cooling chamber 35.

The belt cleaning section 34 is arranged in the vicinity of the cooling fan 43. The cooling chamber 35 is arranged above the belt cleaning section 34. The cooling fan 43 is arranged to face the belt cleaning section 34. The duct 48 is formed to guide the external air introduced by the cooling fan 43 to the cooling chamber 35.

Accordingly, in the present embodiment, the intermediate transfer belt 7 is heated in a manner to be in contact with the photosensitive drums 25 as heat sources and is heated in a manner to receive heat of the fixing section 11 as a heat source. Meanwhile, the cooling chamber 35 is defined immediately above the intermediate transfer belt 7, and the cooling fan 43 introduces the external air to the cooling chamber 35. Thus, the intermediate transfer belt 7 is cooled by the external air introduced to the cooling chamber 35. As a result, each photosensitive drum 25 in contact with the intermediate transfer belt 7 can be cooled.

Herein, the fixing section 11 is arranged on one side of the cooling chamber 35, while the cooling fan 43 and the exhaust port 44 are arranged on the other side thereof. The cooling fan 43 introduces the external air into the cooling chamber 35 from the other side of the cooling chamber 35. The introduced external air flows toward the one side of the cooling chamber 35 and then is blocked by the blocking section 38 to be returned to the other side of the cooling chamber 35. Then, the external air that has cooled the intermediate transfer belt 7 is spontaneously released from the exhaust port 44 on the other side of the cooling chamber 35.

Thus, the intermediate transfer belt 7 can be cooled appropriately. Furthermore, the present embodiment can eliminate the need of an exhaust fan, thereby reducing the apparatus cost. Besides, the exhaust port 44 is formed on the side that faces the fixing section 11. This can mitigate cooling of the fixing section 11 by the external air. Thus, fixing failure in toner images can be reduced in the fixing section 11. In particular in the present embodiment, the cooling chamber 35 is formed such that the external air does not pass through the fixing chamber 11. This can further mitigate cooling of the fixing section 11 by the external air.

In addition, the cooling fan 43 is constituted by an axial fan that rotates counterclockwise when viewing the cooling chamber 35 in the external air introducing direction A. When viewing the cooling chamber 35 in the external air introducing direction A, the cooling fan 43 is arranged in the right part of the cooling chamber 35, while the exhaust port 44 is formed in the left part thereof. With this configuration, the external air is introduced to the right part of the cooling chamber 35 by the cooling fan 43 of the axial fan when viewing the cooling chamber 35 in the external air introducing direction A. Herein, the external air introduced to the cooling chamber 35 flows not only frontward in the axial direction but also obliquely leftward practically when viewed in the external air introducing direction A, as shown in FIG. 2.

Accordingly, the cooling fan 43 arranged in the right part of the cooling chamber can cause the external air to efficiently flow in the entire cooling chamber 35. Besides, the exhaust port 44 formed in the left part of the cooling chamber 35 can smoothly release the air.

Figure 6:
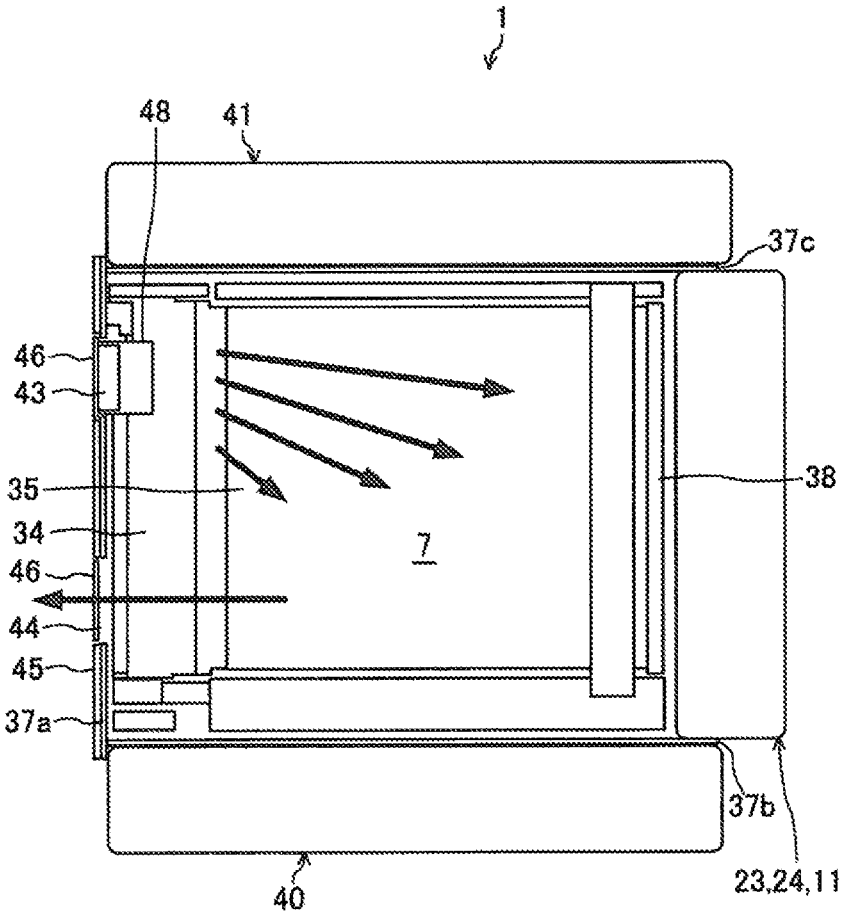
FIG. 6 is a cross sectional view schematically showing a configuration of the image forming apparatus according to another embodiment.

It is noted that the arrangement of the cooling fan 43 and the exhaust port 44 is not limited to the above arrangement. FIG. 6 shows a cross section of the image forming apparatus 1 according to another embodiment.

As shown in FIG. 6, the cooling fan 43 may be constituted by an axial fan that rotates clockwise when viewing the cooling chamber 35 in the external air introducing direction A. In this case, when viewing the cooling chamber 35 in the external air introducing direction A, the cooling fan 43 is arranged in the left part of the cooling chamber 35, while the exhaust port 44 is formed in the right part thereof.

With this configuration, the external air is introduced to the left part of the cooling chamber 35 by the cooling fan 43 of the axial fan when viewing the cooling chamber 35 in the external air introducing direction A. Herein, the external air introduced to the cooling chamber 35 flows not only frontward in the axial direction but also obliquely rightward practically when viewed in the external air introducing direction A, as shown in FIG. 6.

Accordingly, the cooling fan 43 arranged in the left part of the cooling chamber 35 can cause the external air to efficiently flow in the entire cooling chamber 35 in a similar manner to that in the above embodiment. Besides, the exhaust port 44 formed in the right part of the cooling chamber 35 can smoothly release the air.

It should be noted that a color printer have been described as an example of the image forming apparatus in the present embodiment. However, the image forming apparatus according to the present disclosure is not limited to the color printer. The image forming apparatus according to the present disclosure may be any other image forming apparatus including an optical scanning device, such as a copier, a scanner, and a multifunction peripheral.

What is claimed is:

1. An image forming apparatus comprising:

a plurality of photosensitive drums;

an intermediate transfer belt wound to a plurality of rollers and configured to be in contact with outer peripheral surfaces of the photosensitive drums such that toner images are transferred to the intermediate transfer belt from the outer peripheral surfaces of the photosensitive drums;

a transfer section configured to transfer a toner image from the intermediate transfer belt to a sheet;

a cooling chamber configured to cool the intermediate transfer belt and defined immediately above the intermediate transfer belt;

a fixing section arranged on one side of the cooling chamber and configured to fix to a sheet the toner image that the transfer section transfers to the sheet by heating the toner image;

a cooling fan arranged on an opposite side to the one side of the cooling chamber and configured to introduce external air to the cooling chamber, and a frame having an exhaust port for releasing air in the cooling chamber and arranged on the opposite side of the cooling chamber, wherein the cooling fan is an axial fan, the axial fan rotates counterclockwise and is arranged in a right part of the cooling chamber when viewing the cooling chamber in an external air introducing direction in which the external air is introduced to the cooling chamber by the axial fan, and the exhaust port is arranged in a left part of the cooling chamber when viewing the cooling chamber in the external air introducing direction.

2. An image forming apparatus according to claim 1, further comprising:

a blocking section arranged between the cooling chamber and the fixing section.

3. An image forming apparatus according to claim 1, further comprising:

a duct configured to guide the external air blown from the cooling fan to the cooling chamber.

4. An image forming apparatus comprising:

a plurality of photosensitive drums;

an intermediate transfer belt wound to a plurality of rollers and configured to be in contact with outer peripheral surfaces of the photosensitive drums such that toner images are transferred to the intermediate transfer belt from the outer peripheral surfaces of the photosensitive drums;

a transfer section configured to transfer a toner image from the intermediate transfer belt to a sheet;

a cooling chamber configured to cool the intermediate transfer belt and defined immediately above the intermediate transfer belt;

a fixing section arranged on one side of the cooling chamber and configured to fix to a sheet the toner image that the transfer section transfers to the sheet by heating the toner image;

a cooling fan arranged on an opposite side to the one side of the cooling chamber and configured to introduce external air to the cooling chamber, and a frame having an exhaust port for releasing air in the cooling chamber and arranged on the opposite side of the cooling chamber, wherein the cooling fan is an axial fan, the axial fan rotates clockwise and is arranged in a left part of the cooling chamber when viewing the cooling chamber in an external air introducing direction in which the external air is introduced to the cooling chamber by the axial fan, and the exhaust port is arranged in a right part of the cooling chamber when viewing the cooling chamber in the external air introducing direction.

5. An image forming apparatus according to claim 4, further comprising:

a blocking section arranged between the cooling chamber and the fixing section.

6. An image forming apparatus according to claim 4, further comprising:

a duct configured to guide the external air blown from the cooling fan to the cooling chamber.

* * * * *